United States Patent [19]

Hayden

[11] Patent Number: 4,915,640

[45] Date of Patent: Apr. 10, 1990

[54] CENTRAL VACUUM SYSTEM APPARATUS

[76] Inventor: Theodore R. Hayden, 10291 Springhill Crescent, Richmond, British Columbia V7W 1W7, Canada

[21] Appl. No.: 237,213

[22] Filed: Aug. 25, 1988

[51] Int. Cl.[4] ..... H01R 4/60

[52] U.S. Cl. ..... 439/191; 15/410

[58] Field of Search ..... 439/190, 191, 192, 490, 439/193, 194, 195; 15/22 R, 314, 361, 410, 411; 174/47; 200/61.6, 310, 317; 285/7

[56] References Cited

U.S. PATENT DOCUMENTS

| | | | |
|---|---|---|---|
| 3,258,553 | 6/1966 | Breslin | 15/314 |
| 4,624,027 | 11/1986 | Martin | 15/340 |
| 4,652,063 | 3/1987 | Genoa et al. | 439/191 |

FOREIGN PATENT DOCUMENTS

| | | | |
|---|---|---|---|
| 3140131 | 4/1983 | Fed. Rep. of Germany | 15/410 |
| 3204341 | 8/1983 | Fed. Rep. of Germany | 15/410 |

*Primary Examiner*—Neil Abrams
*Assistant Examiner*—Khiem Nguyen
*Attorney, Agent, or Firm*—Christie, Parker & Hale

[57] ABSTRACT

A handle for a vacuum hose of a central vacuum system. There is a body having a first and second end. A nozzle projects outwardly at the first end and there is a recess at the second end to receive the vacuum hose. A pathway through the body joins the recess and the nozzle. There is a handgrip formed on the handle and a first connector means on the body, generally adjacent the first end. There is a switch adjacent the handgrip. Conductors join the first connector to the switch. A second connector on the body is generally adjacent the second end, and conductors join the switch to the second connection means.

4 Claims, 2 Drawing Sheets

CENTRAL VACUUM SYSTEM APPARATUS

FIELD OF THE INVENTION

This invention relates to a handle for a vacuum holder for central vacuum systems.

DESCRIPTION OF THE PRIOR ART

Central vacuum systems are increasingly popular. They comprise a central dirt collecting source and a powerful impeller to generate suction located at that source. The building in which the system is located then has a number of simple wall outlets, not unlike electrical outlet plates, at appropriate locations. It is now virtually standard to have a switch built into the outlet so that insertion of the metal probe of a vacuum hose acts to contact a low voltage supply, which operates the impeller. The hose is then extended from the wall outlet to a simple nozzle. The nozzle may be operated with a brush but the general idea is to suck the dirt into the system and into the central dust collector. This is in marked contrast to the necessity to have to carry around a traditional vacuum cleaner from room to room. Using these central vacuum systems it is only necessary to carry around a lightweight flexible hose.

As indicated the central vacuum system is typically operated by an impeller or fan operating on 24 volts. This has proved to be perfectly adequate. However, there is occasionally a need to use 120 volt appliances with a central vacuum system, for example to operate beaters and the like so that carpets may be given an occasional more thorough cleaning.

This has been a disadvantage with the prior art systems. Applicants' United States prior application, Ser. No. 059,885, filed by June 1987 as a continuation-in-part of application Ser. No. 829,270 filed Feb. 14, 1986 now Pat. No. 4,758,170 issued July 19, 1988 shows an inlet valve for a central vacuum system. The valve has an inlet valve body having an electrical receptacle adjacent an air suction inlet. This allows a simultaneous connection of relatively high voltage components. However, it is still desirable to provide a more compact system, for example in which the leads for the high voltage system can be formed in close association with the hose of the vacuum system thus reducing the hazards of having cables lying around while one is operating the vacuum system. An end piece for a vacuum hose that meets this need is disclosed in the copending U.S. patent application, entitled 'Vacuum System Attachment', filed on even date herewith in the name of Theodore R. Hayden and assigned Ser. No. 236,929, the entire disclosure of which is incorporated herein by reference.

In addition, it is desirable to provide remote operation of the high voltage appliance so that the operator does not have to go back to the wall socket to disconnect the system. It is also desirable to incorporate a vessel indication that the system is receiving power as there can be considerable noise, especially when a component such as a carpet beater is in operation.

It is also desirable to provide a proper handle for the equipment rather than simply having to grip the end of a vacuum pipe.

SUMMARY OF THE INVENTION

Accordingly the present invention provides a handle for a vacuum hose for a central vacuum system comprising:

a body having first and second ends;

a nozzle projecting outwardly at the first end;

a recess at the second end to receive the vacuum hose;

a pathway through the body communicating the recess and the nozzle;

a handgrip formed on the handle;

first connection means on the body, generally adjacent the first end;

a switch adjacent the handgrip;

conductors joining the first connection means to the switch;

second connection means on the body, generally adjacent the second end; and conductors joining the switch to the second connection means.

BRIEF DESCRIPTION OF THE DRAWINGS

Aspects of the invention are illustrated merely by way of example, in the drawings in which.

Figure 1:
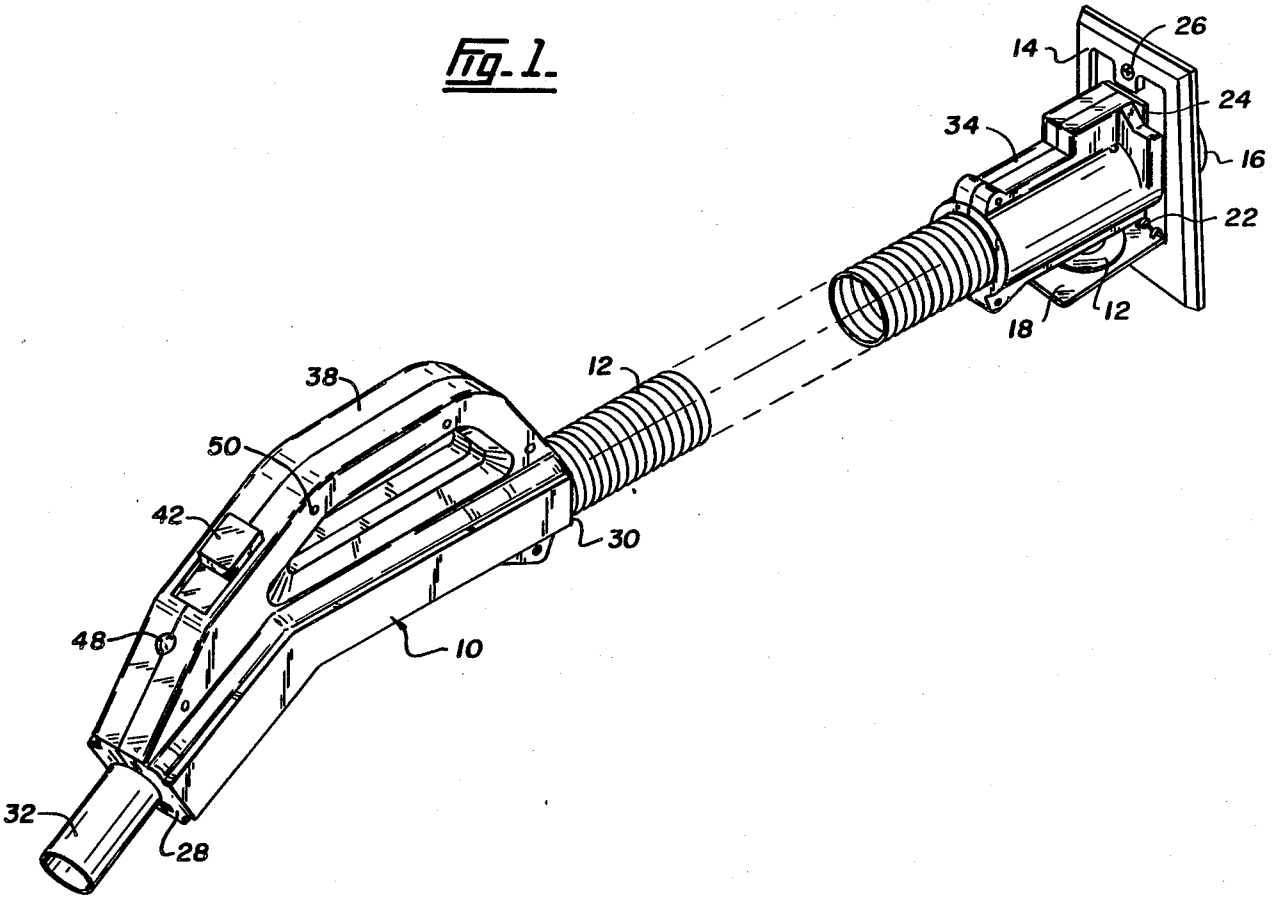
FIG. 1 shows a handle according to the present invention in association with a wall fitting, the flexible pipe and an end piece to attach to the wall fitting.

The drawings show a handle 10 for a vacuum hose 12 of a central vacuum system. The central vacuum system is merely illustrated by the showing of the wall plate 14, a pipe 16 communicates with the remote impeller at the system, a flap 18, which includes a sealing member 12 or the pipe 16, and a spring 22 to urge the flap 18 to close the pipe 16. The wall plate 14 may be as illustrated in applicant's co-pending application Ser. No. 236,929, enitled VACUUM SYSTEM ATTACHMENT and having an electrical socket 24 and screw holes 26 so that the plate may be mounted against the wall. As is conventional the plate includes switches (not shown), typically spring loaded, that can to form a circuit when connected by a metallic nozzle of a vacuum pipe.

The flap 18 is spring loaded to the closed position by springs 22 but is maintained in the open position by the presence of a vacuum pipe.

A handle according to the present invention comprises a body having first end 28 and second end 30. A nozzle 32 project outwardly at the first end 28 and there is a recess 29 at the second end 30 to receive the vacuum hose 12 of the system. As shown particularly, the vacuum hose 12 extends from the handle to an end piece 34 which is preferably as described in said application 'Vacuum System Attachment'.

Figure 2:
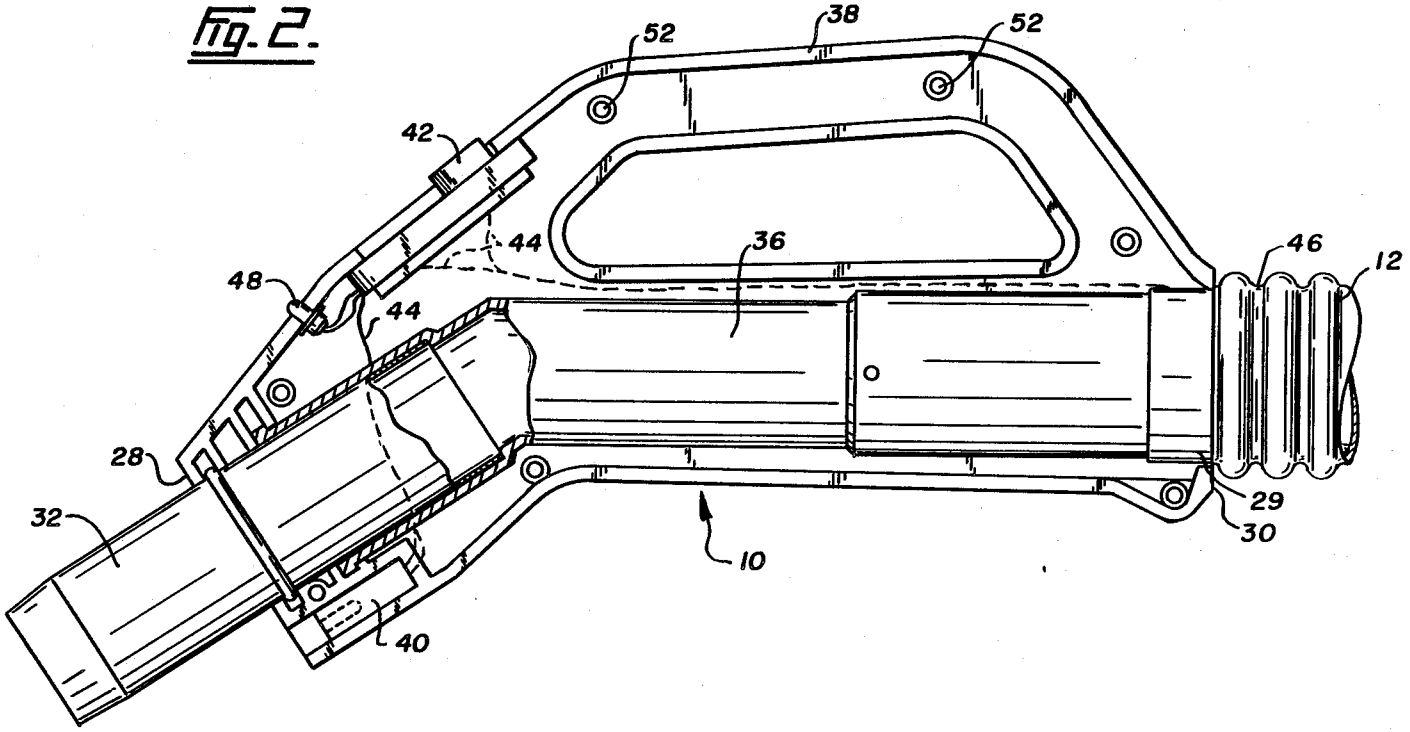
FIG. 2 is an exploded view of the handle of FIG. 1.

As shown in FIG. 2 the handle is hollow, defining a pathway 36 through the body that communicates the recess 29 and the nozzle 32. A hand grip 38 is formed on the handle so that the device may be conveniently carried. There are first connection means 40 on the body, generally adjacent the first end 28. A switch 42 is formed adjacent the hand grip 38 and conductors 44 join the first connection means 40 and the switch 42. At the second end of the body conductors 44 join the switch to a cable 46 associated with hose 12 and receiving power from socket 24.

There is a light 48 to indicate when the switch is live. It may be replaced by a light emitting diode (LED).

The switch 42 is desirably a slide switch. It operates to connect electrically the first and second ends of the handle 10. It may also be a toggle switch.

The handle 10 is formed in two parts. Screws 50 act to hold the two parts together. They are received in openings 52 of FIG. 2. Nozzle 32 is clamped between the first and second parts of the body to locate it. The handle 10 includes means to indicate when a dust collecting bag of the system is full or, indeed, any simple electrical means known in the art, to provide information on the operation of the system.

To use the handle according to the present invention the nozzle of the end piece 34 is inserted into the pipe 16, simultaneously forcing prongs in end piece 34 into the socket 24. The low voltage circuit needed to operate the fan is completed by insertion of the metallic nozzle, which connects switches in the pipe 16 in conventional manner. Similarly, the high voltage circuit is activated by the insertion of the prongs into the socket 24. This means that current is passed from the socket 24, along the cable 46 located on the hose 12 to the switch 42. The operator can then switch on the circuit, if a beater or the like high voltage component is attached, to operate that component. Furthermore, the operation of the beater and, indeed of the vacuum system, is greatly facilitated by the lightweight handle, particularly the hand grip 38 that is provided in the handle of the invention. The light 48 indicates operation of the circuit and, in particular, indicates that the high voltage circuit is alive. Using the handle the use of the central vacuuming probe, and any additional high voltage attachment, is greatly facilitated.

Control of the low voltage circuit can also be controlled at switch 42 by providing switch 42 as a multiposition switch.

I claim:

1. A handle for a vacuum hose of a central vacuum system having a power cable built into said vacuum hose comprising:

a body having a first end and a second end, said body being formed in two halves with means locating the halves of the body together;

a nozzle projecting outwardly at the first end that is clamped between said two halves of said body;

a recess at the second end to receive the vacuum hose;

a pathway through the body communicating the recess and the nozzle;

a handgrip formed integrally with the body of the handle;

first connection means on the body, generally adjacent the first end adapted to engage and receive electrical power from the power cable of the vacuum hose;

a switch adjacent the handgrip;

conductors joining the first connection means to the switch;

second connection means on the body, adjacent the second end for providing power to auxiliary equipment; and conductors joining the switch to the second connection means.

2. A handle as claimed in claim 1 including a light or LED to indicate when the switch is on.

3. A handle as claimed in claim 1 in which the switch is a slide switch.

4. A handle as claimed in claim 1 in which the nozzle is clamped between the first and second halves of the body.

* * * * *

UNITED STATES PATENT AND TRADEMARK OFFICE

CERTIFICATE OF CORRECTION

PATENT NO. : 4,915,640

DATED : April 10, 1990

INVENTOR(S) : Theodore R. Hayden

It is certified that error appears in the above-identified patent and that said Letters Patent is hereby corrected as shown below:

Column 1, line 37, after "filed" delete "by".

Column 2, line 34, after "12" change "or" to -- for --.

Column 2, line 43, after "can" delete "to".

Column 2, line 50, change "project" to -- projects --.

Signed and Sealed this

Seventh Day of January, 1992

*Attest:*

HARRY F. MANBECK, JR.

*Attesting Officer*

*Commissioner of Patents and Trademarks*